US006368420B1

(12) United States Patent
Angevaare et al.

(10) Patent No.: US 6,368,420 B1
(45) Date of Patent: Apr. 9, 2002

(54) DETERGENT COMPOSITION AND METHOD FOR WAREWASHING

(75) Inventors: Petrus Adrianus Angevaare; Paul Flu, both of Maarssen (NL); John Richard Nicholson, Edgewater, NJ (US); Frederik Jan Schepers, Maarssen (NL)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/221,635

(22) Filed: Dec. 23, 1998

(30) Foreign Application Priority Data

Jan. 8, 1998 (EP) ..... 98200024

(51) Int. Cl.[7] ..... C11D 3/386; C11D 3/395; A47L 15/00; A47L 15/44

(52) U.S. Cl. ..... 134/26; 134/25.2; 134/25.3; 134/25.5; 134/29; 510/197; 510/219; 510/221; 510/225; 510/226; 510/228; 510/363; 510/372; 510/374; 510/378; 510/380; 510/381; 510/393; 510/530

(58) Field of Search ..... 510/197, 218, 510/219–221, 224–226, 228, 363, 367, 370, 372, 374, 375, 378–381, 392–393, 530; 134/25.3, 25.5, 26, 25.2, 29

(56) References Cited

U.S. PATENT DOCUMENTS 5,801,137 A * 9/1998 Addison et al. ..... 510/228
5,807,438 A * 9/1998 Lansbergen et al. ..... 134/25.2
5,837,663 A * 11/1998 Nicholson et al. ..... 510/226

FOREIGN PATENT DOCUMENTS

DE 4219620 * 12/1993

* cited by examiner

*Primary Examiner*—Yogendra N. Gupta
*Assistant Examiner*—Brian P. Mruk

(57) ABSTRACT

A chemical cleaning system for a multi-tank or a single-tank mechanical warewashing machine is provided, having at least two separate components for aqueous dissolution or dilution to respective use concentrations, a first component comprising an enzyme or a mixture of an enzyme and a cleaning agent, and a second component comprising a bleach, wherein the first component is introduced into a wash zone or step and wherein the second component is introduced into a post-rinse zone or step.

10 Claims, No Drawings

DETERGENT COMPOSITION AND METHOD FOR WAREWASHING

FIELD OF THE INVENTION

The present invention relates to cleaning compositions and their use in mechanical warewashing, especially in institutional or industrial, multi-tank or single-tank systems having multiple cleaning and rinsing zones or steps.

BACKGROUND OF THE INVENTION

A conventional multi-tank industrial warewashing machine consists of a conveyor belt system having separate prewash, wash, rinse and drying zones. Fresh wash water is introduced into the rinse zone of the machine and is passed cascade-fashion towards the prewash zone while dishware is transported in a countercurrent direction.

The dishwashing compositions used in such machines generally comprise a cleaning ingredient such as an aqueous solution of a caustic agent (e.g. sodium hydroxide), a sequestering agent such as sodium tripolyphosphate, and a chlorine bleaching agent. Contact time of the cleaning composition with the dishware is typically quite short, e.g. about 1 minute. The cleaned dishware is generally rinsed in the final rinse station, using a dilute solution of a rinse aid containing a nonionic surfactant.

A conventional single-tank industrial warewashing machine can be either a 'dump' or a 're-use' machine. In single tank machines of the 'dump' type, the rinse water is used for the next wash cycle. Examples of 'dump'-type machines are the low-temperature single-tank machines which are currently on the US market. Hypochlorite is dosed in the rinse of these US machines in order to comply with US hygiene requirements.

In re-use machines, the water used for the rinse step falls into the tank that contains the detergent solution.

In a variation of the conventional multi-tank system described above, a cleaning component is separately introduced into a prewash or wash zone while the bleaching agent is subsequently introduced into a second wash zone, followed by the rinse zone. As the dishware passes through each zone, most of the solution is circulated within the zones concerned.

One problem which arises in industrial warewashing is the build-up of starch residues. Starch residues are especially hard to remove when dishware is subjected to high temperatures during food preparation and such foods are left for a long time on heated substrates during distribution. A proposed solution to this problem is disclosed by EP-A-282,214. This document relates to a process for cleaning dirty dishware with a non-directional mistlike spray of a strongly alkaline solution.

An industrial dishwashing process using a low alkaline detergent and an enzyme dosed into either a rinsing or washing bath of the dishwasher is described in WO-94/27488 (Henkel-Ecolab). The publication describes a means of compensating for degradation of the enzyme, particularly an amylase, during standstill phases by adding intermittent doses of the enzyme to the washing zone.

German Patent Specification DE-A-4 219 620 describes a domestic dishwasher in which bleach and enzyme containing components are dosed in different stages of the wash process. The enzyme is added during the pre-rinse or at the very beginning of the wash cycle. The bleach is added only during the cleaning cycle after a predetermined time once the wash liquor reaches a desired temperature. There are no examples or suitable compositions described in the specification.

EP-A-510,761 refers to liquid machine dishwashing compositions comprising enzyme material and wax encapsulated bleach particles, and suitable for use in domestic dishwashing machines. These compositions were found to exhibit remarkable storage stability.

WO-96/16152 discloses a cleaning system for a multi-tank mechanical warewashing machine, wherein enzyme and bleach are dosed into different wash tanks or zones of the machine. When applying this last-mentioned cleaning system, good starch and tea-stain removal can be obtained, particularly at moderate enzyme levels.

However, for cost reasons and for reasons of optimal operator safety it is desired to reduce the enzyme concentration in cleaning systems for mechanical warewashing and we found that starch and tea stain removal leave to be desired when applying the system of WO-96/16152 with low enzyme levels.

It is an object of the present invention to provide a cleaning system for an industrial mechanical warewashing machine, which can be effectively applied with low enzyme levels.

It is another object of the invention to provide a cleaning system with which both effective tea-stain removal and good starch removal can be achieved in one cleaning cycle.

It is a further object of the invention to provide an enzymatic cleaning system with which efficient removal of bleachable stains can be achieved.

It is a still further object of the invention to provide a cleaning system in which bleach decomposition in wash tanks or zones does not occur during off-time, and which consequently enables the operator to dose the right amount of bleach material for every wash cycle.

We have now surprisingly found that these objects can be achieved when applying a cleaning system having a bleach component and an enzyme component, wherein the bleach component is dosed into the post-rinse

DEFINITION OF THE INVENTION

Consequently, in a first aspect the present invention provides a chemical cleaning system for a multi-tank or a single-tank mechanical warewashing machine, having at least two separate components for aqueous dissolution or dilution to respective use concentrations, a first component comprising an enzyme or a mixture of an enzyme and a cleaning agent, and a second component comprising a bleach, wherein the first component is introduced into a wash zone or step and wherein the second component is introduced into a post-rinse zone or step.

A highly effective method of warewashing in a multi-tank or single tank, industrial or institutional machine is also described, said method comprising the steps of:

(1) formulating at least two separate components of a chemical cleaning system for aqueous dissolution or dilution to respective use concentrations, a first component comprising an enzyme or a mixture of an enzyme and a cleaning agent, and a second component comprising a bleach;

(2) introducing the first component into a wash zone or step, to clean dirty dishware;

(3) introducing the second component into a post-rinse zone or step to effectively complete the cleaning of the dishware.

DETAILED DESCRIPTION OF THE INVENTION

When using the system of the present invention, it was found that effective starch and stain removal performance could be obtained, even at low enzyme levels in the wash liquor. Reason is that the present system allows for maximum contact times in the wash zones or steps between the enzymes and the dishware to be cleaned owing to minimum enzyme deactivation.

Furthermore, the amount of bleach to be dosed during every wash can be optimised when applying this system.

In systems of the prior art in which the bleach is dosed in one of the wash zones or steps, it is always needed to compensate for bleach deactivation due to the presence of soil in the machine and especially occuring during off-time. In the system of the present invention this is not required since the bleach is dosed in the post-rinse.

The system of the present invention can be applied at a wide range of pH-values. Preferably, the pH of the wash liquor in the wash tank or step in which the enzyme is dosed is in the range of 7–11.5.

The pH of the rinse water in which the bleach material is dosed is desirably in the range of 7–10.5

The system pH is the pH of the aqueous solution resulting from dissolution or dilution to the use concentration of that component which contains most of the cleaning agent. This system pH is of course different from the pH of the neat component, before dilution.

Typical aqueous dissolution or dilution rates (dosing rates) for the component containing the (most) cleaning agent are such that the weight of component per unit volume of water are in the range of from 0.5 to 5 g/l, preferably from 1 to 4 g/l, more preferably from 1 to 3 g/l.

The cleaning agent content of that component may include one or more agents selected from caustic (strongly alkaline) materials, builders (i.e. detergency builders including the class of chelating agents/sequestering agents) and surfactants.

Suitable caustic agents include alkali metal hydroxides, e.g. sodium or potassium hydroxides, and alkali metal silicates, e.g. sodium metasilicate. Especially effective is sodium silicate having a mole ratio of $SiO_2$:$Na_2O$ of from about 1.0 to about 3.3, preferably from about 1.8 to about 2.2, normally referred to as sodium disilicate.

Suitable builder materials (phosphates and non-phosphate builder materials) are well known in the art and many types of organic and inorganic compounds have been described in the literature. They are normally used in all sorts of cleaning compositions to provide alkalinity and buffering capacity, prevent flocculation, maintain ionic strength, extract metals from soils and/or remove alkaline earth metal ions from washing solutions.

The builder material usable herein can be any one or mixtures of the various known phosphate and non-phosphate builder materials. Examples of suitable non-phosphate builder materials are the alkali metal citrates, carbonates and bicarbonates; and the salts of nitrilotriacetic acid (NTA); methylglycine diacetic acid (MGDA); serine diacetic acid (SDA); imino disuccinic acid (IDS); dipicolinic acid (DPA), oxydisuccinic acid (ODS), alkyl and alkenyl succinates (AKS); ethylenediamine tetracetates, oxidized heteropolymeric polysaccharides, polycarboxylates such as polymaleates, polyacetates, polyhydroxyacrylates, polyacrylate/polymaleate and polyacrylate/polymethacrylate copolymers and the terpolymer of polyacrylate/polymaleate and vinyl acetate (ex. Huls), as well as zeolites; layered silicas and mixtures thereof. They may be present in more than one component of the system but in the only component which contains builder, or in that component which contains the most total builder material (in % by wt.), in the range of from 1 to 60, and preferably from 5 to 40, more preferably from 10 to 30.

Particularly preferred builders are citrates, DPA, ODS, alkenyl succinates, carbonates, bicarbonates, the higher molecular weight block copolymers ITA/VA having MW greater than 60,000, maleic anhydride/(meth) acrylic acid copolymers, e.g. Sokalan CP5 ex BASF; NTA and terpolymers, polyacrylate/polymaleate and vinyl acetate (supplied by Huls).

Scale formation on dishes and machine parts are an important problem that needs to be resolved or at least mitigated in formulating a machine warewashing product, especially in the case of low-phosphate (e.g. less than the equivalent of 20% by weight, particularly 10% by weight of sodium triphosphate) and phosphate-free machine warewashing compositions, particularly zero-P machine warewashing.

In order to reduce this problem, co-builders, such as polyacrylic acids or polyacrylates (PAA), and the various organic polyphosphonates, e.g. of the Dequest range, may be incorporated in one or more system components. For improved biodegradability , co-builders, such as the block co-polymers of formula (I) as defined in published PCT patent specification WO 94/17170 may also be used. In any component the amount of co-builder may be in the range of from 0.5 to 10, preferably from 0.5 to 5, and more preferably from 1 to 5% by weight.

Further, the cleaning agent may comprise one or more surfactants. Surfactant may also be present in one or more components of the system. However, in the component which contains the most surfactant, they may be present in a range of up to 20, preferably from 1 to 15, and more preferably from 3 to 15% by weight. Such surfactant (if present) is of course separate from any surfactant used as rinse aid in the rinse phase or step.

Normally, in a properly built or highly built composition as is conventional, only small amounts of low- to non-foaming nonionic surfactant are present, to aid detergency and particularly to suppress excessive foaming caused by some protein soil. Higher amounts of highly detersive surfactants, such as the high HLB nonionic surfactants, the anionic sulphate or sulphonate surfactants and the alkyl polyglycoside class of surfactants, may be used in low builder-containing active/enzyme-based compositions.

These compositions may further include a defoamer. Suitable defoamers include mono- and distearyl acid phosphates, silicone oils, mineral oils, and organic carriers containing long-chain ketones (e.g. the Dehypon series, ex Henkel KgaA, Germany). The compositions may include 0.02 to 2% by weight of defoamer, or preferably 0.05 to 1.0% by weight.

Bleaching Agent

Suitable bleaches for use in the system according the present invention may be halogen-based bleaches or oxygen-based bleaches. Of course, more than one kind of bleach may be used.

If a halogen-based bleach is used, a bleach scavenger must also be applied in the system according to the present invention because of the more aggressive nature of halogen-based bleaches. Said bleach scavenger which is a reducing agent, protects the enzyme from deactivation caused by bleach material which flows via the rinse zone into the wash tank or zone in which the enzyme material is dosed. If the bleach scavenger would not be added, the halogen-based bleach would completely deactivate any enzymes that would be dosed in the next wash cycle.

In view of this protective action, the bleach scavenger—if used—must be introduced into a wash zone or step which is either the zone or step in which the enzyme component is introduced or a zone or step situated between this zone or step and the post-rinse. Preferably, the bleach scavenger is dosed in the final wash zone or step before the post-rinse.

Bleach scavengers useful to prevent the appearance of an enzyme-deactivating concentration of bleach material include reducing agents that can substantially reduce $Cl_2$, HClO and other oxidizing chlorine containing compositions to Cl— ions or which can substantially reduce hydrogen peroxide or peroxy acid bleaches to unoxidized species. The reducing agent should not damage the dishware or substantially chemically change the enzyme, or other cleaning composition components such as the builder and surfactant.

Useful reducing agents include reducing sulphur-oxy acids and salts thereof. Most preferred for reasons of availability, low cost and high performance are the alkali metal and ammonium salts of sulphur-oxy acids including ammonium sulphite ($(NH_4)_2SO_3$), sodium sulphite ($Na_2SO_3$), sodium bisulphite ($NaHSO_3$), sodium metabisulphite ($Na_2S_2O_3$), potassium metabisulphite ($K_2S_2O_5$), and lithium hydrosulphite ($Li_2S_2O_4$). Sodium sulphite is especially preferred.

Another useful reducing agent, though not particularly preferred for reasons of cost, is ascorbic acid.

These reducing agents must be used at sufficient amounts effective to scavenge the chlorine or oxidizing bleach present. It will be appreciated that these amounts will vary from case to case depending on the type, concentration and quality of the bleach material.

It is desirable that the use concentration of the bleach scavenger in the wash zone or step in which it is introduced is in excess of the concentration of the bleach material in said zone or step, whereby said bleach originates from the post-rinse.

If halogen bleach is applied in the system of the present invention, it is desirably present in the component to be introduced in the post-rinse, at a concentration (as active halogen) in the range of from 0.1 to 10%, preferably from 0.5 to 8%, more preferably from 1 to 6%, by weight.

As halogen bleach, alkali metal hypochlorite may be used. Other suitable halogen bleaches are alkali metal salts of di- and tri-chloro and di- and tri-bromo cyanuric acids.

Suitable oxygen-based bleaches are the peroxygen bleaches, such as sodium perborate (tetra- or monohydrate), sodium carbonate or hydrogen peroxide. These are preferably used in conjuction with a bleach activator which allows the liberation of active oxygen species at a lower temperature. Numerous examples of activators of this type, often also referred to as bleach or peracid precursors, are known in the art and amply described in the literature such as in U.S. Pat. Nos. 3,332,882 and 4,128,494 herein incorporated by reference. Preferred bleach activators are tetraacetyl ethylene diamine (TAED), sodium nonanoyloxybenzene sulphonate (SNOBS), glucose pentaacetate (GPA), tetra acetylmethylene diamine (TAMD), triacetyl cyanurate, sodium sulphonyl ethyl carbonic acid ester, sodium acetyloxybenzene and the mono long-chain acyl tetraacetyl glucoses as disclosed in WO 91/10719, but other activators, such as choline sulphophenyl carbonate (CSPC), as disclosed in U.S. Pat. Nos. 4,751,015 and 4,818,426 can be used.

Peroxybenzoic acid precursors are known in the art as described in GB 836,988, herein incorporated by reference. Examples of suitable precursors are phenylbenzoate, phenyl p-nitrobenzoate, o-nitrophenyl benzoate, o-carboxyphenyl benzoate, p-bromophenyl benzoate, sodium or potassium benzoyloxy benzene-sulfonate and benzoic anhydride.

Preferred peroxygen bleach precursors are sodium p-benzoyloxy-benzene sulfonate, N,N,N,N-tetraacetyl ethylene diamine (TAED), sodium nonanoyloxybenzene sulfonate (SNOBS) and choline sulfophenyl carbonate (CSPC).

The amounts of sodium perborate or percarbonate and bleach activator in the bleach component preferably do not exceed 30% and 10% by weight, respectively, e.g. from 4–30% and from 2–10% by weight, respectively.

Furthermore, organic peroxyacids may be effectively used as bleach material in the bleach component of the system of the present invention. Such materials normally have the general formula:

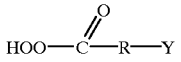

wherein R is an alkylene or substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a COOH, or a

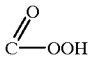

group or a quaternary ammonium group.

Typical monoperoxy acids useful herein include, for example:

(i) peroxybenzoic acids and ring-substituted peroxybenzoic acids, e.g. peroxy-alpha-naphthoic acid;

(ii) aliphatic, substituted aliphatic and arylalkyl monoperoxyacids, e.g. peroxylauric acid, peroxyatearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxy brassilicacid; diperoxysebasic acid and diperoxyisophthalic acid;

(vii) 2-decyldiperoxybutane-1,4-diotic acid; and (viii) 4,4'-sulphonylbisperoxybenzoic acid Also inorganic peroxyacid compounds, such as for example potassium monopersulphate (MPS), are suitable for use in the bleach component of the system of the present invention. All these peroxy compounds may be utilised alone or in conjunction with a peracid precursor as described above. If present, the concentration of the peroxyacid in the bleach containing component of the system of the invention is suitably 0.1–20%, preferably 0.5–15%, more preferably 1–10% by weight.

The observed bleaching performance of the system according to the present invention could be further improved by the addition to the bleach component of a transition metal complex catalyst. Preferred transition metal complexes for use as bleach catalyst are complexes of iron or manganese containing ligands so as to result in hydrolytically stable complexes. Examples are manganese complexes having, as a ligand, an 1,4,7-trimethyl-1,4,7-triazacyclononane structure, as disclosed by EP-A-458,397.

If present, the preferred use concentration of these transition metal complexes in the rinse is in the range of 0.1–20 microMol/liter.

Another group of compounds which can improve the bleaching performance are the transition metal containing enzymes, for instance the peroxidases.

Enzymatic Component

Amylolytic and/or proteolytic enzymes would normally be used. The amylolytic enzymes usable herein can be those derived from bacteria or fungi. Preferred amylolytic enzymes are those prepared and described in GB Patent No. 1,296,839, cultivated from the strains of Bacillus licheniformis NCIB 8061, NCIB 8059, ATCC 6334, ATCC 6598, ATCC 11945, ATCC 8480 and ATCC 9945 A. An example of such amylolytic enzymes is the amylase produced and distributed under the tradename Termamyl by Novo Industri A/S, Copenhagen, Denmark. Other suitable types of amylases because of their oxidation stability are Duramyl (ex Novo) and Purafect OxAm (ex Genencor).

These amylolytic enzymes are generally presented as granules or liquids and may have enzyme activities of from about 2 to 25 Maltose Units/milligram. They may be present in the enzyme component of the invention in amounts such that the final use composition of said enzyme component has amylolytic enzyme activity of from 10 to $10^8$ Maltose Units/kilogram, preferably from $10^2$ to $10^6$ MU/kg and more preferably from $10^2$ to $10^4$ MU/kg.

The amylolytic activity as referred to herein can be determined by the method as described by P. Bernfeld in "Method of Enzymology", Volume I (1955), page 149.

The proteolytic enzymes usable herein are, for example, the subtilisins which are obtained from particular strains of *B. subtilis* and *B. licheniformis,* such as the commercially available subtilisins Maxatase, supplied by Gist-Brocades N. V., Delft, Holland, and Alcalase, supplied by NOVO Industri A/S, Copenhagen, Denmark. Particularly suitable are proteases obtained from a strain of Bacillus having maximum activity throughout the pH range of 8–12, being commercially available from NOVO Industri A/S under the tradenames of Esperase an Savinase. The preparation of these and analogue enzymes is described in GB Patent No. 1,243,784. These enzymes are generally presented as granules, e.g. marumes, prills, T-granulates, etc., or liquids and may have enzyme activities of from 500 to 6,000 Glycine Units/mg. The proteolytic enzyme activity can be determined by the method as described by M. L. Anson in "Journal of General Physiology", Vol. 22 (1938), page 79 (one Anson unit/gram=733 Glycine Units/milligram).

In the compositions of the invention, proteolytic enzymes may be present in amounts such that the final use composition of the enzyme component has proteolytic enzyme activity of from about 10 to $10^{10}$ Glycine Units/kilogram, preferably from $10^2$ to $10^{10}$ and more preferably $10^4$ to $10^9$.

Other enzymes, such as lipolytic enzymes, may also be incorporated to improve fat removal. Typical examples of commercial lipolytic enzymes are Lipase YL, Amano CE, Wallerstein AW, Lipase My, and Lipolase ex. Novo Industries.

As indicated above, although the cleaning agent, bleach and enzyme may be present in more than one component of the system, generally speaking, components which contain one of these three classes of ingredients will be substantially free or totally free of the others, apart from the exceptions defined in the following description of preferred orders of application of the components.

Typical industrial warewashing processes are either continuous or non-continuous and are conducted in either a single tank or a multitank/conveyor type machine. In the conveyor system prewash, wash, post-rinse and drying zones are generally established using partitions. Wash water is introduced into the rinsing zone and is passed cascade fashion back towards the prewash zone while the dirty dishware is transported in a countercurrent direction.

The inventive chemical cleaning system may be utilized in any of the conventional warewashing processes.

In multi-tank/conveyor type machines, contact time between the cleaning composition and the articles to be washed is relatively short. Means of maximizing these contact times are constantly sought while at the same time any negative interaction time of the actives of the cleaning composition needs to be minimized to provide the best cleaning performance.

In sequential dosing, components of the cleaning composition are separately introduced into different compartments of the machine. Thus, sequential dosing separates active ingredients to minimize negative interactions and thereby maximize cleaning performance of each individual component.

When applying the system of the invention in a multi-tank machine, the bleach component preferably containing a halogen bleach, is desirably first introduced into the post-rinse zone, the cleaning agent is then introduced into a second wash zone, and the enzyme component is introduced into a third washing zone. In this preferred embodiment, a bleach scavenger is effectively introduced with the enzyme so that traces of bleach do not deactivate the introduced enzyme.

Each component of the chemical cleaning system of the invention is applied in the warewashing machine using conventional means such as suitable spray nozzles or jets directed upwards and/or downwards toward the dishware. In a preferred embodiment, the enzyme component is sprayed directly onto the dishware as it moves through. A thorough rinsing of the enzyme from the dishware should follow.

Minor amounts of various other components may be presented in the chemical cleaning system. These components include bleach scavengers, solvents, and hydrotropes such as ethanol, isopropanol and xylene sulfonates, flow control agents; enzyme stabilizing agents; soil suspending agents; antiredeposition agents; anti-tarnish agents; anti-corrosion agents; colorants and other functional additives.

Particularly useful silver anti-tarnishing agents include benzotriazole or 1,3-N azole compounds described in U.S. Pat. No. 5,468,410 (Angevaare et al.) and U.S. Pat. No. 5,480,576 (Gary et al.) herein incorporated by reference.

Isocyanuric acid may also be used as an antitarnishing agent and described in U.S. Pat. No. 5,374,369 (Angevaare et al.) also incorporated by reference.

Components of the present invention may independently be formulated in the form of solids (optionally to be dissolved before use), aqueous liquids or non-aqueous liquid (optionally to be diluted before use).

The present invention will now be described in more detail by way of the following non-limiting examples, in which parts and percentages are by weight unless otherwise indicated.

EXAMPLES 1, A–C

The cleaning efficiency of a system according to the invention in which hypochlorite bleach is dosed in the rinse, was compared to the cleaning efficiency of a prior art system in which hypochlorite bleach is dosed in the wash.

In total, 4 cleaning experiments were carried out in a single-tank warewashing machine.

During all these experiments one or more wash-rinse cycles were performed. In these cycles, first a wash step was carried out during 30 seconds, in which 5 liter water was used. Subsequently, a rinse step was carried out during 30 seconds, in which again 5 liter water was used. Both steps were carried out at a temperature of 60° C. In all these experiments a potassium disilicate buffer was added to the water to be used for the wash step, for obtaining a pH of 10. The concentration of said buffer was 1.42 g/l.

In one experiment, no builder was used. In the other 3 experiments, the above wash-rinse cycle was carried out 3 times per experiment, whereby different builders were used during the wash step, viz.: nitrilotriacetate (NTA), Sokalan CP 7 (a polyacrylate/maleate), and sodium tripolyphosphate (STP). The concentration of the builder in the wash liquor was 0.56 g/l.

In one experiment, the hypochlorite bleach was used in the rinse step. In the other 3 experiments the bleach was applied in the wash step. The concentration of the hypochlorite bleach in the wash liquor respectively the rinse solution was such that 15 ppm av. Cl was present therein.

In 2 of the 4 experiments, soil was introduced into the wash liquor, said soil amounting to 20 gram ASTM (being a mixture of margarine to milk powder in a weight ratio of 4:1). The application of this type of soil in the wash liquor is done to reflect the commercial situation, wherein always some soil is present in wash zone or step. For each wash-rinse cycle, porcelain cups were used which were previously stained with tea three times.

Summarizing, the following experiments were carried out in examples 1,A–C:

A: no soil, no builder, hypochlorite bleach in wash;

B: no soil, 0.56 g/l builder (NTA, Sokalan CP7, STP) in wash, hypochlorite bleach in wash;

C: +20 g ASTM soil, 0.56 g/l builder (NTA, Sokalan CP7, STP) in wash, hypochlorite bleach in wash;

1: +20 g ASTM soil, 0.56 g/l builder (NTA, Sokalan CP7, STP) in wash, hypochlorite bleach in rinse.

Consequently, the experiment of Example 1 is according to the present invention, whereas the experiments of Examples A–C are according to the prior art.

During these experiments, the extent of cleaning obtained was assessed using a visual score, in which 4 is very poor cleaning, 3 is poor cleaning, 2 is moderate cleaning, 1 is good cleaning, and 0 is completely clean.

The tea-stain removal results obtained were as follows:

| Example | type of builder | 1 | A | B | C |
|---|---|---|---|---|---|
| score | NTA | 0.6 | — | 0.4 | 1.6 |
| " | Sokalan CP7 | 0.5 | — | 0.3 | 1.5 |
| " | STP | 0.9 | — | 0.6 | 2.0 |
| " | no builder | — | 3.1 | — | — |

It was thus observed that the inventive system of example 1 exhibited significantly better tea-stain removal performance than the prior art system of example C in which also soil was applied in the wash liquor.

Furthermore, it was observed that good tea-stain removal can be obtained even with hypochlorite bleach in the wash, when no soil is present in the wash liquor (see example B). However, in that case (i.e. no soil in wash) builder material needs to be present, since otherwise acceptable cleaning results can not be obtained (see example A).

EXAMPLE 2, D, E

In these examples, the effect of applying a bleach scavenger on the cleaning efficiency of a system according to the invention hasw been tested in a single-tank machine.

In total, 3 cleaning experiments were carried out, whereby the same test method was used as the method applied in examples 1,A–C.

The cleaned dishware was then observed by a panel which rated tea and starch removal on a percentage scale with 100% representing total stain and soil removal.

In these experiments, the following ingredients were dosed in the wash step, to obtain the indicated use concentrations:

| | |
|---|---|
| Termamyl 300L | 0.02 g/l |
| NTA | 0.30 g/l |
| Potassium disilicate | 1.42 g/l |

Furthermore, in all these experiments a known rinse aid was applied in the rinse step, in a use concentration of 0.25 g/l.

In one experiment, no hypochlorite bleach was used. In the second experiment, sodium hypochlorite bleach was dosed in the wash step to obtain 25 ppm active $Cl_2$ in the wash liquor. In the third experiment, sodium hypochlorite bleach was dosed in the rinse step to obtain 25 ppm active $Cl_2$ in the rinse water. In this third experiment sodium sulphite bleach scavenger was used in the wash step, at a use concentration of 25 ppm.

The cleaning performance was determined using residual tea stain and residual starch tests. Porcelain cups were stained with tea 3 times prior to one washing. In addition, porcelain plates were soiled with potato starch. To mimic the gradual build-up of starch soil due to incomplete removal of the starch in one wash, the starch plates were resoiled after the first wash and in total subjected to 5 consecutive wash/starch soiling procedures.

No additional soil was added to the wash liquor used in the wash step.

Summarizing, the following experiments were carried out in Examples 2, D and E:

D: no soil, 0.3 g/l builder, hypochlorite bleach and Termamyl 300L in wash;

E: no soil, 0.3 g/l builder, no bleach, Termamyl 300L in wash;

2: no soil, 0.3 g/l builder, Termamyl 300L and sodium sulphite bleach scavenger in wash, hypochlorite bleach in rinse.

The tea stain and starch removal results were as follows:

| soil-type: | D | E (% clean) | 2 |
|---|---|---|---|
| tea-stain | 100 | 92 | 97 |
| starch | 30 | 95 | 95 |

It was thus observed that the inventive system of example 2 exhibited better starch removal performance than the prior art system of Example D in which hypochlorite bleach was applied in the wash. It was further observed that the tea stain removal performance of the inventive system of example 2 was better than that of the prior art system of example E in which no bleach was applied at all.

EXAMPLES 3,4, F

In these examples, the effect of applying a bleach scavenger on the cleaning efficiency of a system according to the invention, has been tested in a multi-tank machine. Cleaning experiments were carried out in a multi-tank machine having 3 wash tanks followed by a rinse tank. The cleaned dishware was then observed by a panel which rated tea and starch removal on a percentage scale with 100% representing total stain and soil removal.

In these experiments, the following ingredients were dosed into the 3rd wash tank, to obtain the indicated use concentrations:

| | |
|---|---|
| Termamyl 300L | 0.06 g/l |
| Trilon A (40%) | 1.75 g/l |
| potassium silicate ($SiO_2$:$K_2O$ = 2.15) | 0.30 g/l |
| KOH (50%) | 0.15 g/l |

Furthermore, in all these experiments a known rinse aid was applied in the rinse tank in a use concentration of 0.25 g/l. In one experiment, no hypochlorite was used. In the other experiments, sodium hypochlorite was dosed into the rinse tank, to obtain 25 ppm active $Cl_2$ in the rinse water. In one of the experiments in which hypochlorite bleach was applied in the rinse tank, sodium sulphite bleach scavenger was used in the 3rd wash tank, at a use concentration of 25 ppm.

The tea stain and starch removal performance was determined using cups and plates which were soiled as described in examples 2, D and E. No additional soil was added to the wash liquor in the 3rd wash tank.

Summarizing, the following experiments were carried out in the Examples 3, 4 and F:

F: Termamyl 300L in 3rd wash tank, no bleach in rinse;

3: Termamyl 300L in 3rd wash tank, hypochlorite bleach in rinse, no bleach scavenger;

4: Termamyl 300L and sodium sulphite in 3rd wash tank, hypochlorite bleach in rinse.

The tea-stain and starch removal results were as follows:

| Soil-type: | F | 3 (% clean) | 4 |
|---|---|---|---|
| tea-stain | 60 | 90 | 84 |
| starch | 70 | 35 | 100 |

It was thus observed that the inventive system of Example 4 exhibited the best starch removal performance. This is a result of the use of sodium sulphite in said example, which material enhances amylase enzyme stability.

EXAMPLES 5–8

In these examples, the effect of enzyme dosage on the cleaning performance of a system according to the invention has been tested.

Cleaning experiments were carried out in a multi-tank machine having 3 wash tanks followed by a rinse tank. The cleaned dishware was then again observed by a panel which rated tea and starch removal on a percentage scale with 100% representing total stain and starch removal For all these experiments, the following ingredients were dosed into the 3rd wash tank, to obtain the indicated use concentrations:

| | |
|---|---|
| Trilon A (40%) | 1.75 g/l |
| KOH (50%) | 0.15 g/l |
| potassium silicate ($SiO_2$:$K_2O$ = 2.15) | 0.30 g/l |

Furthermore, in all experiments hypochlorite bleach as well as a known rinse aid were dosed into the rinse tank. The amount of hypochlorite was such that 1.5% active $Cl_2$ was resent in the rinse tank.

Termamyl 300L was dosed into the 3rd wash tank to obtain use concentrations varying from 0 g/l to 0.06 g/l.

The tea stain and starch removal performance was measured using cups and plates which were soiled as described in Examples 2,D and E. The following results were obtained:

| | Dosage: | Starch removal (% clean) | Tea-stain removal (% clean) |
|---|---|---|---|
| 5: | 0 g/l Termamyl 300L | 12 | 100 |
| 6: | 0.02 g/l Termamyl 300L | 32 | 100 |
| 7: | 0.04 g/l Termamyl 300L | 52 | 100 |
| 8: | 0.06 g/l Termamyl 300L | 84 | 100 |

It was thus observed that starch removal performance drastically improved with increasing enzyme dosage.

What is claimed is:

1. A cleaning system for a multi-tank or a single-tank mechanical warewashing machine having at least two separate components for aqueous dissolution or dilution to respective use concentrations, a first component comprising an enzyme or a mixture of an enzyme and a cleaning agent, and a second component comprising a bleach, wherein the first component is introduced into a wash zone and wherein the second component is introduced into a post-rinse zone.

2. The system according to claim 1, wherein the bleach of the second component is a halogen bleach and wherein the system comprises a third component being a bleach scavenger, said third component being introduced in a wash zone which is the zone in which the first component is introduced or a zone which is situated between this zone and the post-rinse.

3. The system according to claim 2, wherein the bleach scavenger of the third component is introduced in the last wash zone before the post-rinse.

4. The system according to claim 2, wherein the bleach scavenger of the third component is selected from the group consisting of alkali metal and ammonium salts of sulphur-oxy acids.

5. The system according to claim 2, wherein the use concentration of the bleach scavenger in the wash zone in which said scavenger is introduced is in excess of the concentration of the bleach in said wash zone, said bleach coming from the post-rinse.

6. The system according to claim 1, wherein the enzyme present in the first component is selected from the group consisting of an amylase, a protease, a lipase and mixtures thereof.

7. The system according to claim 6, wherein the enzyme present in the first component is an amylase.

8. A method of warewashing in a multi-tank or single-tank, industrial or institutional machine, comprising the steps of:

(1) formulating at least two separate components of a chemical cleaning system for aqueous dissolution or dilution to respective use concentrations, a first component comprising an enzyme or a mixture of an enzyme and a cleaning agent, and a second component comprising a bleach;

(2) introducing the first component into a wash zone, to clean dirty dishware;

(3) introducing the second component into a post-rinse zone or step to effectively complete the cleaning of the dishware.

9. A method of warewashing in a multi-tank or single-tank, industrial or institutional machine, comprising the steps of:

(1) formulating three components of a chemical cleaning system for aqueous dissolution or dilution to respective use concentrations, a first component comprising an enzyme or a mixture of an enzyme and a cleaning agent, a second component comprising a bleach, and a third component comprising a bleach scavenger agent;

(2) introducing the first component into a wash zone to clean dirty dishware;

(3) introducing the third component containing the bleach scavenger into a wash zone which is the zone in which the first component is introduced, or situated between this zone and the post-rinse zone; and (4) introducing the second component containing the bleach into the post-rinse zone.

10. A method according to claim 9, wherein the third component containing the bleach scavenger is introduced into the last wash zone before the post-rinse zone.

* * * * *